US012257522B2

(12) United States Patent
VanStavern et al.

(10) Patent No.: US 12,257,522 B2
(45) Date of Patent: Mar. 25, 2025

(54) MODEL ROCKETS WITH DIVISIBLE NOSE CONES

(71) Applicants: Thomas A. VanStavern, Columbus, OH (US); Mark R. Wilson, Columbus, OH (US)

(72) Inventors: Thomas A. VanStavern, Columbus, OH (US); Mark R. Wilson, Columbus, OH (US)

( * ) Notice: Subject to any disclaimer, the term of this patent is extended or adjusted under 35 U.S.C. 154(b) by 100 days.

(21) Appl. No.: 17/980,154

(22) Filed: Nov. 3, 2022

(65) Prior Publication Data

US 2023/0249092 A1 Aug. 10, 2023

Related U.S. Application Data

(60) Provisional application No. 63/275,393, filed on Nov. 3, 2021.

(51) Int. Cl.
*A63H 27/00* (2006.01)
*A63H 27/14* (2006.01)

(52) U.S. Cl.
CPC ..... *A63H 27/005* (2013.01); *A63H 27/001* (2013.01); *A63H 27/14* (2013.01)

(58) Field of Classification Search
CPC .... A63H 27/00; A63H 27/001; A63H 27/005; A63H 27/14; A63H 33/20
USPC ..... 446/34, 52
See application file for complete search history.

(56) References Cited

U.S. PATENT DOCUMENTS 3,006,109 A * 10/1961 Boese ..... A63H 27/00 446/34
3,292,302 A * 12/1966 Estes ..... A63H 27/005 446/212
3,397,481 A * 8/1968 Boese ..... A63H 27/005 446/52
3,719,145 A * 3/1973 Brown et al. ..... F42B 15/36 102/351
3,787,013 A * 1/1974 McKenzie, Sr. ..... A63H 27/14 446/52
3,795,194 A * 3/1974 Kendrick ..... A63H 33/20 446/52

(Continued)

FOREIGN PATENT DOCUMENTS

CN 110379283 A 10/2019

*Primary Examiner* — Alexander R Niconovich
(74) *Attorney, Agent, or Firm* — BECKMAN LAW P.C.; Christopher Beckman

(57) ABSTRACT

Systems, devices and methods for model rocketry are provided. According to some aspects, new forms of model rocket nose cones, other model rocket components, and methods for their use, are provided. A new form of reversibly-divisible nose cone is provided, including a plurality of housing sections forming an interior payload section and, in some embodiments, including a locking mechanism(s) configured to hold the plurality of housing sections together during the initial phases of flight. In some embodiments, such a locking mechanism is unlocked, and the housing sections are separated, at least in part, in an ejection phase of model rocket flight. In some embodiments, such a locking (Continued)

mechanism is unlocked, at least in part, by increased air resistance and tension from shock cord(s) of a model rocket. Shock cord mounting arms are provided, including eyelet(s), mounted at an angle to a trailing surface of the nose cone.

20 Claims, 10 Drawing Sheets

(56) References Cited

U.S. PATENT DOCUMENTS 3,949,520 A * 4/1976 Lebensfeld ..... A63H 33/20 446/51
4,038,776 A * 8/1977 Filipeli ..... A63H 33/20 446/52
4,356,662 A * 11/1982 Strasser ..... A63H 27/14 446/52
4,466,213 A * 8/1984 Alberico ..... A63H 33/185 446/64
5,054,397 A * 10/1991 Hans ..... F42B 10/56 446/52
5,407,375 A * 4/1995 Johnson ..... A63H 27/14 446/52
5,549,497 A * 8/1996 Johnson ..... A63H 27/14 446/52
5,653,216 A * 8/1997 Johnson ..... A63H 27/14 124/75
5,712,446 A * 1/1998 Spence ..... F42B 4/08 446/56
5,785,278 A * 7/1998 Bejtlich, III ..... B64D 17/62 446/52
5,839,940 A * 11/1998 Ensmenger ..... A63H 27/14 446/212
5,951,354 A * 9/1999 Johnson ..... A63H 27/14 446/52
6,022,260 A * 2/2000 Fritzel ..... A63H 27/005 446/87
6,478,648 B1 * 11/2002 Applewhite ..... A63H 33/20 446/52
8,006,936 B1 * 8/2011 Farr, III ..... F42B 4/28 244/151 B
11,806,637 B2 * 11/2023 Frawley ..... A63H 27/005
2004/0102130 A1 * 5/2004 Hogan ..... A63H 27/005 446/34
2015/0024653 A1 * 1/2015 Huebl ..... A63H 33/20 446/52
2021/0016194 A1 * 1/2021 Qin ..... A63H 27/001
2024/0082746 A1 * 3/2024 Richter ..... A63H 27/005

* cited by examiner

MODEL ROCKETS WITH DIVISIBLE NOSE CONES

CROSS-REFERENCE TO RELATED APPLICATION

This application claims the benefit of co-pending U.S. patent application No. 63/275,393, filed Nov. 3, 2021, titled "Model Rockets with Divisible Nose Cones," the entire contents of which are hereby incorporated by reference herein in their entirety.

TECHNICAL FIELD

The present invention relates to fields of rocketry and, in particular, model rocketry, and rocket nose cones.

BACKGROUND

Modern model rocketry rose to prominence in the early 1950s, due to heightened interest driven by the "space race," a competitive effort by the United States and Soviet Union to advance the exploration of outer space. Hobbyists' enthusiasm for model rocketry was not always tempered by sufficient expertise and safety, and critics soon emerged, noting the dangers of volatile liquid rocket fuels used by amateurs. For example, G. Harry Stine, of Popular Mechanics, noted these dangers regularly in articles during this time period. Children in particular are drawn to model rocketry, due to their active imaginations and interest in the unknown frontier of outer space, but their appreciation for safety is far lower than that of adults.

Amid this backdrop, Orville and Robert Carlisle, two brothers with expertise in pyrotechnics and model rocketry, developed a new, safer form of model rocket engine, in a standard form to be inserted into a re-usable model rocket body. See U.S. Pat. No. 2,841,084, entitled "Toy Rocket," to Orville H. Carlisle. This new model rocket engine was intended to be single-use and disposable, preventing tampering, refueling or tinkering by the amateur hobbyists. Consulting further with model rocketry pioneer Vernon Estes, the brothers developed an even safer, more reliable form of the engine, using safer, solid rocket fuels. Eventually, Estes began an independent company based on these model rocketry improvements—Estes Industries.

Critics, including Stine himself, were impressed with these safety improvements, and model rocketry became ever more popular, and remains an extremely popular hobby to the present day. Throughout the intervening decades, space flight and model rocketry have experienced regular resurgences in interest, and to this day, Estes Industries leads the amateur model rocketry market.

Yet, notwithstanding this considerable time period, the essential design and components of model rockets still strongly resemble those of model rockets in the 1950s and 1960s.

The present invention presents a number of improvements and new designs for model rockets, as will be set forth in greater detail below.

It should be noted that some of the disclosures set forth as background, such as, but not limited to, the above language under the heading "Background," do not relate exclusively to prior art and the state of the art in the field(s) of the invention, and should not be construed as an admission with respect thereto.

SUMMARY

Systems, devices and methods for model rocketry are provided. According to some aspects of the invention, new forms of model rocket nose cones, other model rocket components, and methods for their use, are provided. In some embodiments, a new form of reversibly-divisible nose cone is provided, including a plurality of housing sections (e.g., 2 ("two") housing sections) and, in some embodiments, a locking mechanism(s) configured to hold the plurality of housing sections together. In some embodiments, such a locking mechanism is unlocked, and the housing sections are separated, at least in part, by the fluid dynamics of the surrounding air flow (e.g., greater exposure to air resistance during and after an ejection phase) during model rocket flight. In some embodiments, such a locking mechanism is unlocked, at least in part, by an ejection charge issuing from a model rocket engine. In some embodiments, such a locking mechanism is unlocked, at least in part, by tension from shock cord(s) of a model rocket. In some embodiments, a plurality of such locking mechanisms are provided for a single nose cone. In some such embodiments, such locking mechanism(s) are provided at particular points where the plurality of housing sections are joined. For example, in some embodiments, such a locking mechanism is provided on or about a tip of the nose cone. As another example, in some embodiments, such a locking mechanism is provided on or about a lower section of the nose cone. However, in some embodiments, such a locking mechanism is provided over a wider area of the plurality of housing sections. For example, in some embodiments, such a locking mechanism is provided along a length of abutting parallel edges of such a plurality of housing sections being held together by the locking mechanism.

In some embodiments, such a locking mechanism includes one or more tab(s) and pockets configured to interlock with such tabs. In some embodiments, such tab(s) and pocket(s) are in the form of a tongue-and-groove locking mechanism. In some such embodiments, such a tongue-and-groove of such a locking mechanism are each flat-surfaced, interfacing with each other at a flat angle, and are held together by surface friction. In some embodiments, such a locking mechanism is in the form of a dovetail joint. In some embodiments, such a locking mechanism is in the form of one or more interlocking hooks. In some embodiments, such a locking mechanism is in the form of one or more interlocking barbs.

In particular, in some such embodiments, a plurality of shock cord mounting arms, extending, one each, from a lower housing wall of each of the plurality of housing sections, are included. In some such embodiments, such shock cord mounting arms are curved or angled. In some such embodiments, such shock cord mounting arms include at least one mounting point, for connecting one or more model rocket shock cord(s). In some such embodiments, such a mounting point is an eyelet, through which a shock cord is threaded. In some such embodiments, the shock cord(s) are then knotted, tied or otherwise attached to the mounting points in preparation for a model rocket flight. In some embodiments, such a shock cord(s) is/are wound around such a plurality of shock cord mounting arms in preparation for a model rocket flight. During an ejection phase of such a model rocket flight, the shock cord(s) then unfurl from the plurality of shock cord mounting arms, aiding in the separation of the plurality of housing sections.

In some embodiments, the plurality of housing sections may include a number of additional aspects. For example, in some embodiments, at least one of the plurality of housing sections includes one or more gas-channeling openings, permitting air and/or an ejection charge to enter and aid in separating the plurality of housing sections. Examples embodiments of some such openings are set forth below, in reference to FIGS. 5*a* and 5*b*. However, in some embodiments, at least one of the plurality of housing sections includes an outward-facing, sloped lower surface(s) at a lower part of the housing, causing an ejection charge to press the plurality of housing sections together (at least initially during an ejection phase). For example, FIG. 11, below, discloses a tapered transitional area of a lower portion of a nose cone housing section, which serves as such an outward, sloped lower surface.

As another example, in some embodiments, the shock cord mounting arms may be provided in the form of a spool, about which one or more shock cord(s) may be wound. In some such embodiments, when such a shock cord is so wound around such a spool, the inward pressure of the shock cord aids in pressing the plurality of housing sections together until ejection. For example, one such example of such a type of housing section forming a spool is provided in FIGS. 11 and 12. As yet another example, in some embodiments, one or more of the plurality of housing sections may include one or more internal structural support(s). For example, in some embodiments, such a structural support(s) includes one or more internal strut(s), within the housing sections. In some such embodiments, an interconnected group of such strut(s) is included. Some examples of the above types of strut(s) are provided in reference to FIGS. 7*a*-8*b*, below. In some embodiments, at least when connected, such a plurality of housing sections form an internal payload bay(s). In some such embodiments, such a payload bay(s) includes protective walls, protecting a payload placed within the payload bay(s). Some examples of payload bay(s) in accordance with some aspects of the present invention are provided below, in reference to FIGS. 2-4, below.

Further aspects of the invention will be set forth in greater detail, below, with reference to the particular figures.

BRIEF DESCRIPTION OF THE DRAWINGS

The features and advantages of the example embodiments of the invention presented herein will become more apparent from the detailed description set forth below when taken in conjunction with the following drawings.

DETAILED DESCRIPTION

The example embodiments of the invention presented herein are directed to systems, devices and methods for model rocketry, including reversibly-divisible model rocket nose cones with a plurality of housing sections, other model rocket components, and systems and methods for their use, which are now described herein. This description is not intended to limit the application of the example embodiments presented herein. In fact, after reading the following description, it will be apparent to one skilled in the relevant art(s) how to implement the following example embodiments in alternative embodiments.

Figure 1:
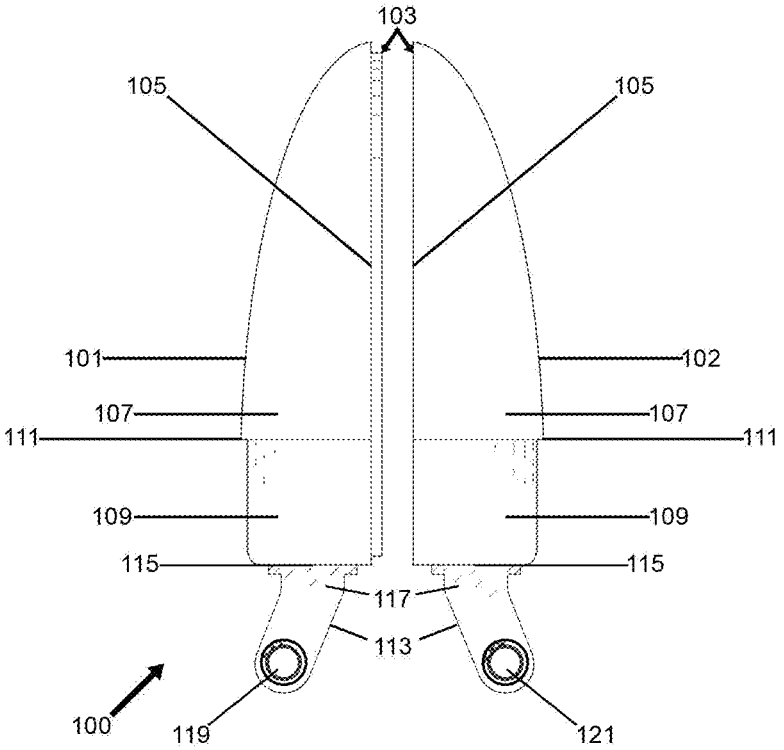
FIG. 1 is an example side view of an example plurality of housing sections for forming a reversibly-divisible nose cone, in accordance with some embodiments of the present invention.

FIG. 1 is an example side view of an example plurality of housing sections 100 for forming a reversibly-divisible nose cone for a model rocket, in accordance with some embodiments of the present invention. In the example embodiment pictured, housing sections 100 include two separate housing sections—namely, housing section 101 and housing section 102. However, according to some embodiments of the present application, reversibly-divisible nose cones may include any suitable number of housing sections, in addition to, or alternatively to, example housing section 101 and housing section 102. For example, in some embodiments, a reversibly-divisible nose cone includes three housing sections. As another example, in some embodiments, a reversibly-divisible nose cone includes four housing sections. As yet another example, in some embodiments, a reversibly-divisible nose cone includes five or more housing sections. Furthermore, although plurality of housing sections 100 are pictured as entirely separate from one another, in some embodiments, a plurality of housing sections for forming a reversibly-divisible nose cone are partially attached, and partially separated, in comparison to a more fully attached condition for which they are also configured to have (e.g., hinged together, with an additional fastener to reversibly prevent hinge movement during launch.) Also, although the embodiment pictured as plurality of housing sections 100 are separate, it should be understood that they are configured to be reversibly joined together (e.g., with a reversible joint). For example, in some embodiments, housing section 101 and housing section 102 each include part of a reversible locking mechanism, for joining and holding them together. In some such embodiments, such a reversible locking mechanism is, or includes, a fastener (e.g., a reversible fastener, such as a snap). In some embodiments, such a reversible locking mechanism is another form of reversible joint. For example, as pictured, each of housing section 101 and housing section 102 include part of reversible joint 103, which may be such a locking mechanism. As discussed elsewhere in this application, in some embodiments, a locking mechanism, such as reversible joint 103, is provided along a length of abutting parallel edges of such a plurality of housing sections being held together by the locking mechanism. For example, in some embodiments, reversible joint 103 may include a tongue-and-groove type fastener, housing section 101 including the "tongue" or male part of such a fastener, and housing section 102 including the groove or female part of such a fastener. As pictured, in some embodiments, such parts of a reversible locking mechanism may be located on or about example interfacing surfaces 105, where housing section 101 and housing section 102 are to be joined together. However, it is within the scope of the present application that a number of other locations, numbers and types of fasteners and locking mechanisms may be used, in addition to or as an alternative to, example reversible joint 103, may be included, in various embodiments, as will be understood by those skilled in the art. In some embodiments, a plurality of locking mechanisms are provided for reversibly forming a single nose cone. In some such embodiments, such locking mechanism(s) are provided at particular points where the plurality of housing sections are joined. Additional, example embodiments of such alternative forms of locking mechanisms are set forth in greater detail below.

As with other model rocket systems, a model rocket system using the nose cone of the present invention may involve rocket flights in conventional phases, including: 1) a launch phase, 2) a flight phase, 3) a peak phase, 4) an ejection phase (e.g., deploying a parachute, streamer or other drag device), 5) a descent phase, and 6) a recovery phase. During such an ejection phase, an ejection charge from an upper part of a single-use solid rocket fuel engine (or other form of rocket engine) may be directed upward, toward a nose cone mounted on the main body of the rocket, in some embodiments. In some embodiments, when joined, reversible joint 103 has a sufficient strength to hold housing section 101 and housing section 102 together when the nose cone they form is mounted on the main body of a rocket, throughout a launch phase, flight phase and peak phase of a model rocket flight. However, in some embodiments, reversible joint 103 will cease holding housing section 101 and housing section 102 together, and increased forces (air resistance, centrifugal and/or other forces) cause housing section 101 and housing section 102 to separate, after the ejection phase. For example, in some embodiments, housing section 101 and housing section 102 are more greatly exposed to an environment external to a main body of a rocket, after such an ejection phase, bringing such forces to bear. In some embodiments, housing section 101 and housing section 102 may each include multiple, at least partially rounded or otherwise curved housing portions: A) an upper housing portion 107, which is at least partially conical, to be exposed during a flight phase and a peak phase of a model rocket flight, and B) a lower housing portion 109, including a neck 110 (configured to insert into a main body of a rocket) which is at least partially cylindrical, having a smaller, inset outer surface diameter than the upper portion. In some embodiments, the outer surface diameter of such an upper housing portion has a cylindrical outer surface with a diameter that matches, or substantially matches, the cylindrical outer surface diameter of a main body of a model rocket. Thus, in some embodiments, a lip 111 formed at the transition between the upper housing portion 107 and the lower housing portion 109 abuts, and forms a flush surface with, an upper edge of a main body of a rocket, which is a hollow cylinder. Such embodiments are discussed in greater detail below, in reference to FIG. 3.

In some such embodiments, a plurality of shock cord mounting arms 113 are included, extending, one each, from lower housing walls 115 of each of the plurality of housing sections 100. In some embodiments, the shock cord mounting arms 113 are attached to, and/or integrated with, lower housing walls 115. In some such embodiments, such shock cord mounting arms are curved or angled, for example, due to mounting arm bend(s) 117. In some such embodiments, such shock cord mounting arms include at least one mounting point, for connecting one or more shock cord(s). For example, in some such embodiments, such a mounting point is an eyelet, such as example shock cord mounting eyelet 119 and example shock cord mounting eyelet 121. In some embodiments, to connect a model rocket shock cord(s) to each of the plurality of shock cord mounting arms 113, the shock cord(s) are threaded through example shock cord mounting eyelet 119 and/or example shock cord mounting eyelet 121. In some such embodiments, the shock cord(s) are then knotted, tied or otherwise attached in preparation for a model rocket flight. In some embodiments, such a shock cord(s) is/are wound around such a plurality of shock cord mounting arms in preparation for a model rocket flight.

As with any other embodiment, example, and or figure set forth in the present application, the embodiments set forth in, and discussed with reference to, FIG. 1 are not exhaustive, and are merely examples, of the many alternative embodiments falling within the scope of the invention, as will be readily apparent to those of skill in the art. Thus, the embodiments set forth in, and discussed with reference to, FIG. 1, are not limiting, and should not be read to limit any claims of the present application.

Figure 2:
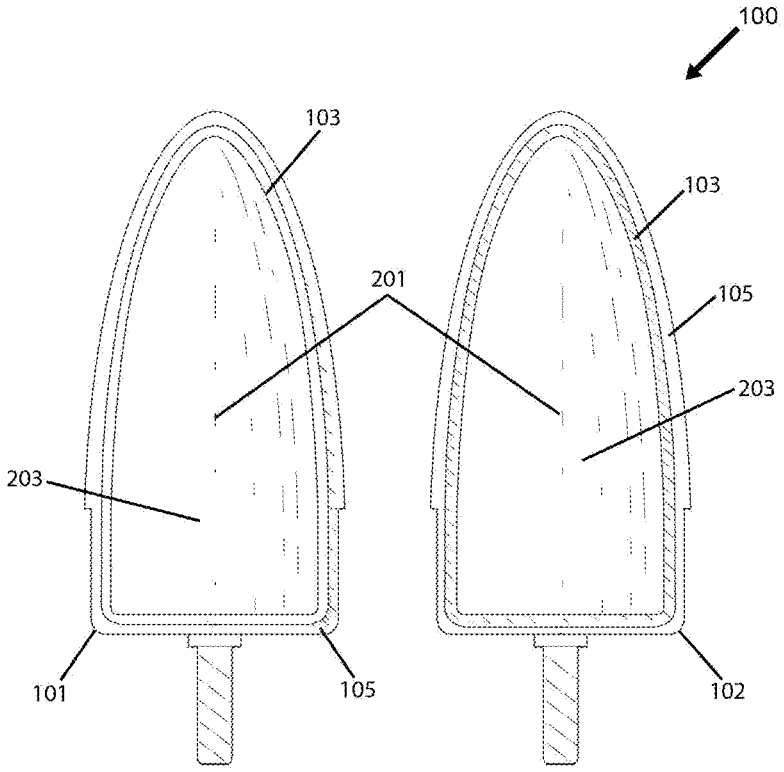
FIG. 2 is another side/interior view of the example plurality of housing sections for forming a reversibly-divisible nose cone of FIG. 1, above, in accordance with some embodiments of the invention.

FIG. 2 is a side/interior view of the same example plurality of housing sections 100 set forth above—namely, the same housing section 101 and housing section 102—for forming a reversibly-divisible nose cone of FIG. 1, in accordance with some embodiments of the invention. From the new angle presented in the figure, one can see that, in some embodiments, both housing section 101 and housing section 102 are hollow, each including and defining at least one internal void(s) 201. In some embodiments, internal void(s) 201 are, or include, one or more payload-carrying volume, such as example payload bay(s) 203.

Also, pictured in greater detail in the view of FIG. 1, in some embodiments, a locking mechanism such as reversible joint 103 may line, or substantially line, a perimeter of the example interfacing surfaces 105.

Figure 3:
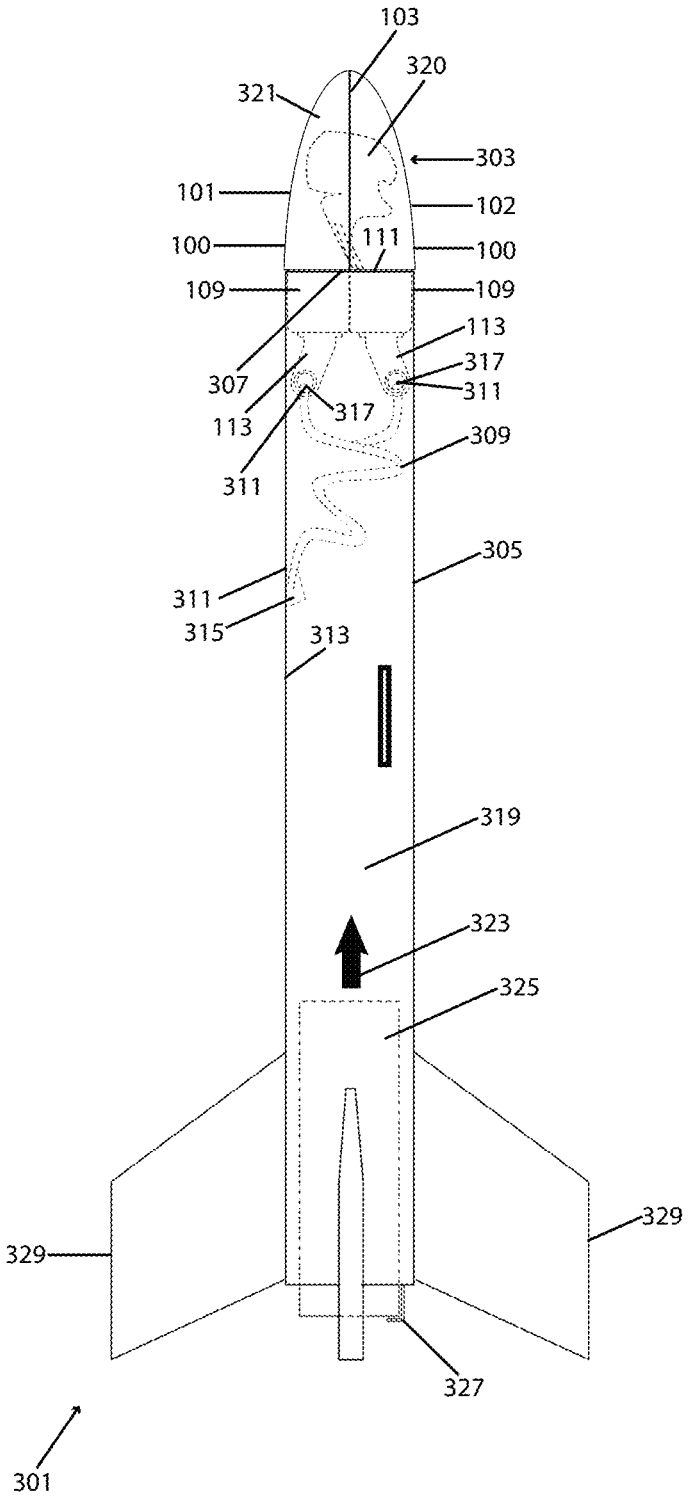
FIG. 3 is a side view of an example assembled model rocket, including the example reversibly-divisible nose cone set forth in reference to FIGS. 1 and 2, above, according to some embodiments of the present invention.

FIG. 3 is a side view of an example assembled model rocket 301, including an example reversibly-divisible nose cone 303, formed from the plurality of housing sections 100, set forth in reference to FIGS. 1 and 2, above, according to some embodiments of the present invention. As can be seen from the view pictured, housing section 101 and housing section 102 have been joined, fastened together by reversible joint 103, forming reversibly-divisible nose cone 303. Furthermore, also as discussed above, reversibly-divisible nose cone 303 was inserted into a cylindrical main body 305 of model rocket 301. Due to the smaller circumference of the outer surface of the lower housing portions 109 relative to that of cylindrical main body 305, again, as discussed above, reversibly-divisible nose cone 303 is able to be inserted into main body 305 up and until a lip 111 abuts the upper edge 307 of main body 305. In some embodiments, the outer surface circumference of the lower housing portions 109 matches, or substantially matches, the interior circumference of cylindrical main body 305. However, in some embodiments, the outer surface circumference of the lower housing portions 109 may slightly exceed (e.g., by 1%) the interior circumference of cylindrical main body 305, to maintain a tighter fit. In some embodiments, friction-increasing ribs may be included on the outer surface of lower housing portions 109. Some such embodiments will be discussed in greater detail below.

In some embodiments, assembled model rocket 301 may include a number of additional components, at least some of which are not conventional. For example, in some embodiments, multiple shock cords, and/or a new form of split-ended shock cord 309, may be included. In such embodiments, such a shock cord includes multiple ends 311, at least one of which may be mounted to an interior surface 313 of main body 305 (e.g., glued onto main body 305 with on a shock cord mounting tab 315), but each of a plurality of nose cone-attaching ends 317 of split-ended shock cord 309 being threaded through and/or attached to, one of the plurality of housing sections 100 of nose cone 303. As discussed above, and as pictured, in some embodiments, shock cord(s) may be separately attached to each of the plurality of housing sections 100 via shock cord mounting arms 113.

One conventional component of a model rocket which has been omitted in the present figure is protective wadding, which might ordinarily be provided within main body 305 at or about the location shown as wadding area 319. Especially in embodiments where a parachute, such as example parachute 320, is held within nose cone 303 (e.g., in payload bay 321), nose cone 303 may provide sufficient protection from an ejection charge emanating upward through main body 305, as shown by example vector arrow 323 from single-use, solid fuel rocket engine 325, that wadding is not necessary to protect it (or any other drag device or other payload object(s).

Other more conventional components of model rocket 301 may include a rocket motor holding bracket 327, guiding fins 329, and a launch rod guide 331. Of course, in various embodiments, other conventional and unconventional rocket components may also be included. For example, in some embodiments, another form of rocket engine or motor, other than single-use, solid fuel rocket engine, may be included in model rocket 301 (e.g., a repackable and/or refillable rocket engine). In some embodiments, amateur or professional grade rocket components may instead be included, in addition to, or instead of, model rocket components.

Figure 4:
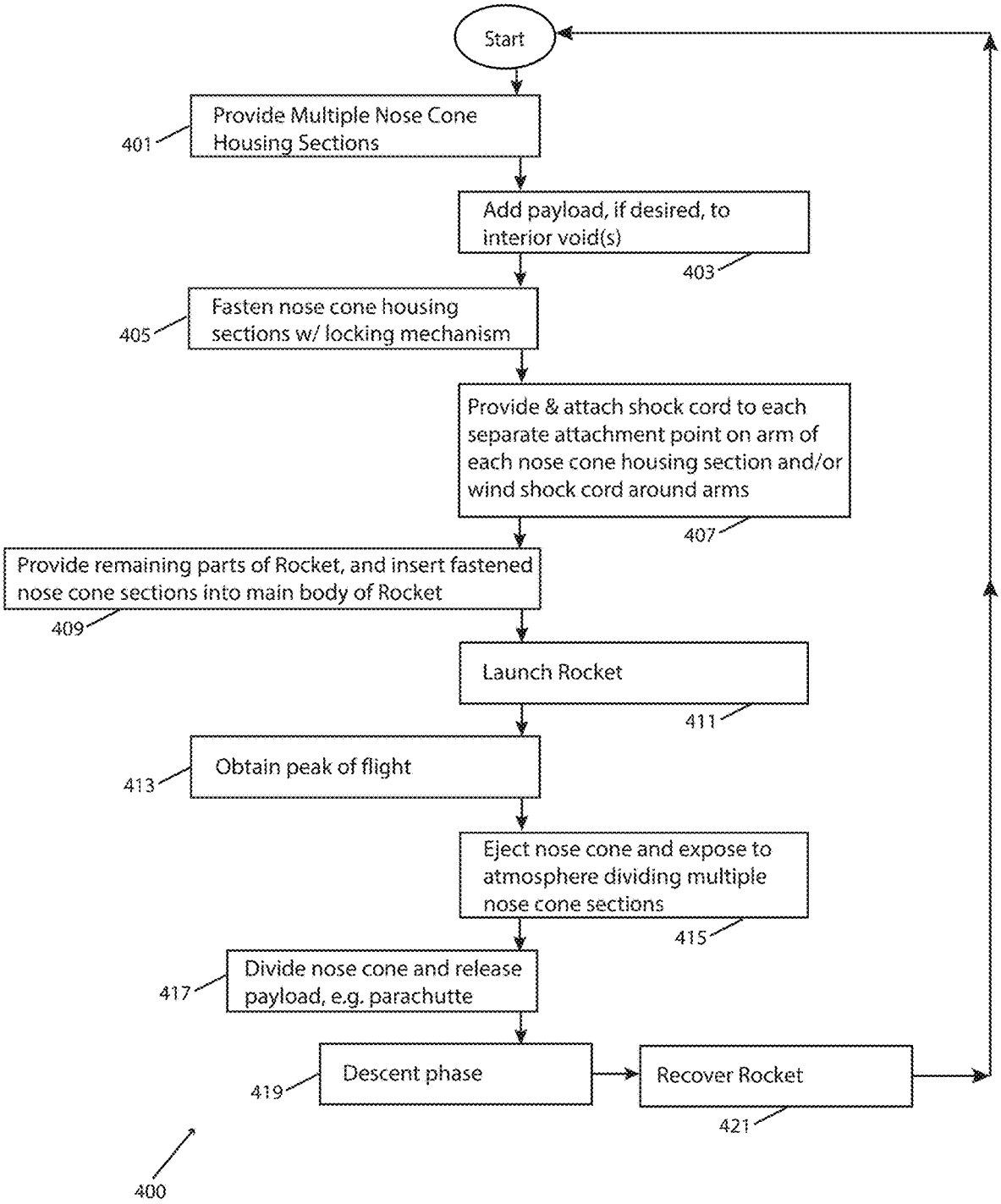
FIG. 4 is an example process flow diagram, depicting some example steps that may be carried out with a reversibly-divisible nose cone, such as any of the example reversibly-divisible nose cones set forth in the present application.

FIG. 4 is an example process flow diagram, of a process 400 that may be undertaken by a user(s) implementing some example embodiments of the present invention described herein (e.g., conducting a model rocket flight using a model rocket including a reversibly divisible nose cone). More specifically, process 400 includes some example steps that may be carried out with such a reversibly-divisible nose cone, such as any of the example reversibly-divisible nose cones set forth in the present application.

At step 401, in some embodiments, a plurality of housing sections for forming a reversibly-divisible nose cone is provided. Examples of such a plurality of housing sections are provided elsewhere in this application (for example, as housing section 101 and housing section 102, set forth above). Proceeding to step 403, in some embodiments, the user(s) proceeds to add an object(s) to an internal payload bay formed by internal void(s) (e.g., such as internal void(s) 201) of each of the plurality of housing sections. Proceeding next to step 405, the user(s) then proceed to assemble a reversibly-divisible nose cone by locking each of the plurality of housing sections together (e.g., using any of the locking mechanism(s) set forth in the present application, in various embodiments), creating such a payload bay enclosing such an object(s).

Proceeding to step 407, the user(s) obtain a model rocket shock cord (such as example split-ended shock cord 309) and attach the end(s) of the model rocket shock cord to shock cord mounting arm(s) attached to one or more of the plurality of housing sections (e.g., at a lower surface of the plurality of housing sections). In some embodiments, the user(s) may also, or alternatively, wind the shock cord around the shock cord mounting arms and, in some embodiments, such winding aids in holding the plurality of housing sections together until an ejection phase of a rocket flight. Prior to that time, however, in step 409, the user(s) may next provide additional parts of a model rocket, such as those set forth in reference to FIG. 3, above, and assemble them with the reversibly-divisible nose cone, to form a fully assembled model rocket, ready for flight. For example, in some embodiments, the user(s) may insert a lower housing portion (such as example lower housing portion 109, discussed above) into a main body of the rocket, as discussed above. Such additional parts may also include a main body, a rocket motor, and flight-guiding fins, among other parts, in some embodiments. In some embodiments, the user(s) may then proceed to launch the fully assembled model rocket, in step 411.

As discussed elsewhere in this application, following launch the model rocket may obtain a peak altitude during flight (e.g., after the engine propellant has been exhausted), in step 413. In some embodiments, the nose cone may then be ejected from the main body of the model rocket and more fully exposing it to atmosphere around the model rocket (e.g., by the firing of an ejection charge from the top end of the model rocket engine, directed at the nose cone), in step 415. In some embodiments, forces from that exposure then come to bear on the nose cone, reversing the locking mechanism(s), and dividing the nose cone into a plurality of nose cone sections (which are no longer directly attached and/or fixed in orientation to one another, in some embodiments). As a result, in step 417, the object(s) held within the payload bay are then released into the atmosphere, in some embodiments. For example, in some embodiments, such an object(s) is a parachute, streamer, or other drag device, tethered to the plurality of housing sections (e.g., to an interior wall of the payload bay). The model rocket may then enter a descent phase, in step 419, after which it may be recovered by the user(s), in step 421. In some embodiments, after the steps 401 et seq. have been completed, the process restarts.

Of course, the embodiments set forth herein are only examples of the wide range of options for implementing new forms of divisible model rocket nose cones, and other rocket components, falling within the scope of the invention, as will be readily apparent to a person of ordinary skill in the art implementing the present invention. For practical reasons, a particular example order and number of steps have been set forth as steps 401 et seq., but it will also be readily understood that, in various embodiments, fewer, more or a different order of steps may be followed, still within the scope of the invention.

Figure 5A:
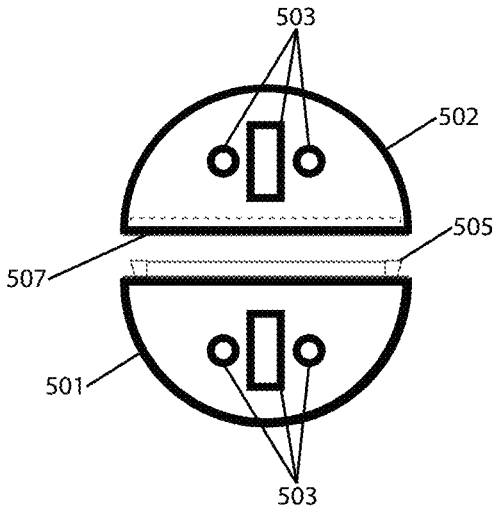
FIG. 5*a* is an example bottom view of an example reversibly-divisible nose cone including gas-channeling openings, permitting air and/or an ejection charge to enter and separate a plurality of housing sections of the reversibly-divisible nose cone, in accordance with some embodiments of the invention.

FIG. 5*a* is an example bottom view of an example plurality of housing sections—namely, housing section 501 and housing section 502—for forming a reversibly-divisible nose cone, which housing sections include gas-channeling openings 503, permitting air and/or an ejection charge to enter into an internal void of the plurality of housing sections, and separate the plurality of housing sections of the reversibly-divisible nose cone, in accordance with some embodiments of the invention. In some embodiments, openings (a.k.a., holes) within nose cone housing sections are provided for fastening a shock cord, as discussed below, in relation to FIGS. 11 and 12.

Also pictured in the present figure, a new form of locking mechanism is provided, including at least one male tab 505, of housing section 501, which fits a complementary female notch 507, of housing section 502. In some embodiments, male tab 505 can be snapped into place within female notch 507, creating a dovetail joint locking the plurality of housing sections together, and forming a reversibly-divisible nose cone.

Figure 5B:
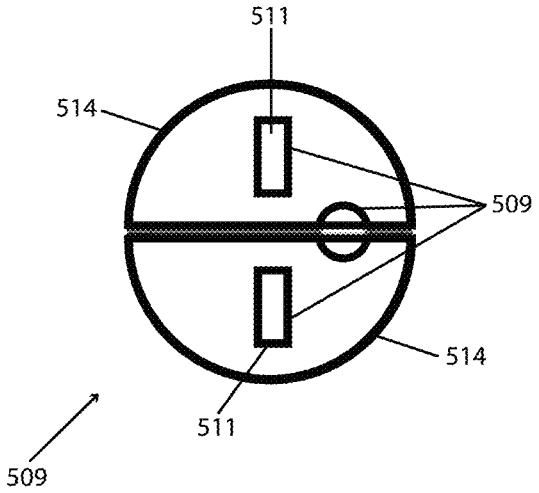
FIG. 5*b* is an example bottom view of another example reversibly-divisible nose cone including gas-channeling openings, similarly permitting air and/or an ejection charge to enter and separate a plurality of housing sections of the reversibly-divisible nose cone, but also including additional, gas-channeling characteristics, in accordance with some embodiments of the invention.

FIG. 5*b* is an example bottom view of another example reversibly-divisible nose cone 500 including alternative format gas-channeling openings 509, permitting air and/or an ejection charge to enter and separate a plurality of housing sections of the reversibly-divisible nose cone, and also including additional, gas-channeling characteristics, in accordance with some embodiments of the invention. As with plurality of gas-channeling openings 503, gas-channeling openings 509 may include a variety of gas-channeling shapes, such as rectangular gas-channeling openings 511 and round gas-channeling opening 513. However, unlike gas-channeling openings 503, round gas-channeling opening 513 may be formed, in part, by each of a plurality of housing sections 514, in some embodiments. Also in contrast with gas-channeling openings 503, in some embodiments, at least some of gas-channeling openings 509 may include an elongated channel, extending some length inward into an internal void 515 of reversibly-divisible nose cone 500, directing an ejection charge into an upper section of nose cone 500 (i.e., toward a tip of nose cone 500 (not pictured in the present figure.)

Although some of the above embodiments include ejection charge channeling holes in the lower walls of a nose cone housing(s), it should be understood that, in some other embodiments, no holes whatsoever are provided in the lower walls of a nose cone housing(s). In some embodiments, a solid surface is provided for the lower walls of a nose cone housing(s).

Figure 6A:
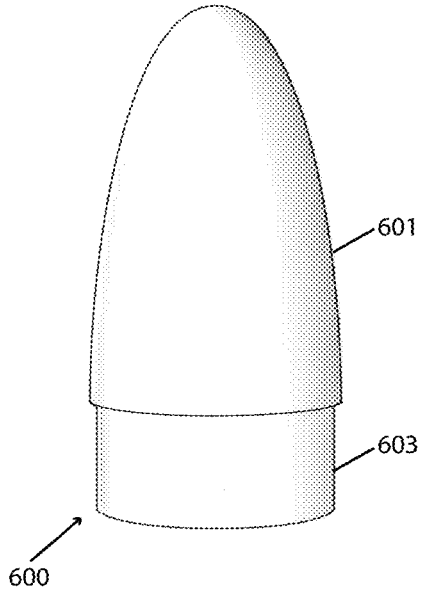
FIG. 6*a* is an example side/exterior view of another example reversibly-divisible nose cone, similar in nature to the reversibly-divisible nose cone set forth above, in reference to FIGS. 1-3, as set forth above.

FIG. 6*a* is an example side/exterior view of another example reversibly-divisible nose cone 600, similar in nature to the reversibly-divisible nose cone set forth above, in reference to FIGS. 1-3, as set forth above. In some embodiments, reversibly-divisible nose cone 600 includes a conical upper portion 601, to be exposed during flight, having a greater diameter than an inset cylindrical lower portion 603. Also, in some embodiments, cylindrical lower portion 603 has the same, or approximately the same, diameter as an interior surface of a cylindrical main body of a rocket (not pictured in the present figure), into which it therefore may be tightly inserted. In some embodiments, however, cylindrical lower portion 603 has a slightly larger diameter than an interior surface of a cylindrical main body of a rocket. In some other embodiments, cylindrical lower portion 603 has a slightly smaller diameter than an interior surface of a cylindrical main body of a rocket. In some of the above embodiments, conical upper portion 601 has an exterior surface diameter substantially matching the exterior surface diameter of the main body of a rocket into which it is inserted, creating a substantially flush transition between the two surfaces.

It should be noted that, although examples of at least partially elliptical nose cone are provided—meaning, an elliptical in shape when viewed from the side (or having an "elliptical profile") to be inserted to a particular depth pictured, is provided in figures of the present application, a number of different, other forms and shapes of nose cone, seated in different ways, and to different depths within a main body of a rocket (with or without a seamless transition) may instead be included, in other embodiments. For example, in some embodiments of any of the nose cone aspects of the present application, such a nose cone are rounded in shape when viewed from the side (having a "rounded profile"). As another example, in some embodiments of any of the nose cone aspects of the present application, such a nose cone is semi-elliptical in shape when viewed from the side (having an "a semi-elliptical profile"). As another example, in some embodiments of any of the nose cone aspects of the present application, such a nose cone has a long elliptical shape when viewed from the side (having an "a long elliptical profile"). As another example, in some embodiments of any of the nose cone aspects of the present application, such a nose cone has a parabolic shape when viewed from the side (having an "a parabolic profile"). As another example, in some embodiments of any of the nose cone aspects of the present application, such a nose cone has an ogive shape when viewed from the side (having an "an ogive profile"). As another example, in some embodiments of any of the nose cone aspects of the present application, such a nose cone has an at least partially cylindrical shape when viewed from the side (having an "a cylindrical profile"). As another example, in some embodiments of any of the nose cone aspects of the present application, such a nose cone has wing(s), a faring(s) and/or fin(s). As another example, in some embodiments of any of the nose cone aspects of the present application, such a nose cone includes a canopy. As another example, in some embodiments of any of the nose cone aspects of the present application, such a nose cone includes a bridge. As another example, in some embodiments of any of the nose cone aspects of the present application, such a nose cone includes a window (e.g., for mounting a camera inside the nose cone's payload bay). As another example, in some embodiments of any of the nose cone aspects of the present application, such a nose cone includes a capsule (e.g., for mounting a camera inside the nose cone's payload bay).

Figure 6B:
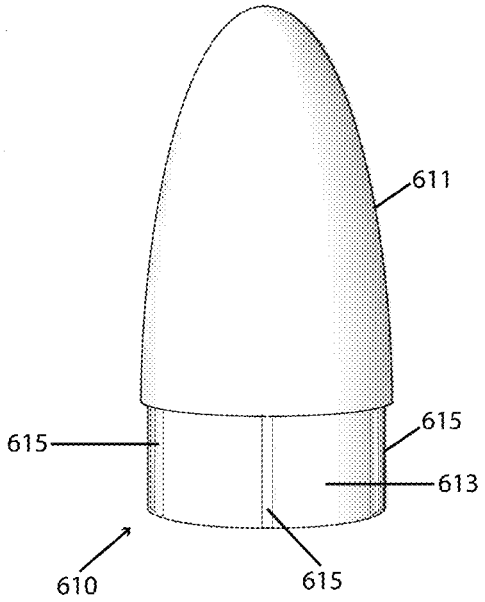
FIG. 6*b* is an example side/exterior view of another example reversibly-divisible nose cone, similar in nature to the reversibly-divisible nose cone set forth above, in reference to FIGS. 1-3, as set forth above, including raised ribs extending from a portion of the nose cone, in some embodiments.

FIG. 6*b* is an example side/exterior view of another example reversibly-divisible nose cone 610, similar in nature to the reversibly-divisible nose cone 600, set forth above, including but including a conical upper portion 611, to be exposed during flight, having a greater diameter than an inset cylindrical lower portion 613, but also having a series of raised ribs 615, extending from the exterior surface 617 of inset cylindrical lower portion 613. In some such embodiments, and especially in embodiments where cylindrical lower portion 613 has a generally smaller diameter than an interior surface of a cylindrical main body of a rocket (not pictured in the present figure), into which it may be inserted, the outer diameter of raised ribs 615 may match the interior diameter of the main body of the rocket. As a result, a lower amount of friction (or, stiction) may result between raised ribs 615 and the main body of the rocket, in comparison to the amount of friction (stiction) between nose cone 600 and a main body of a rocket (such as the rocket main body 305, set forth above, in FIG. 3).

Figure 7A:
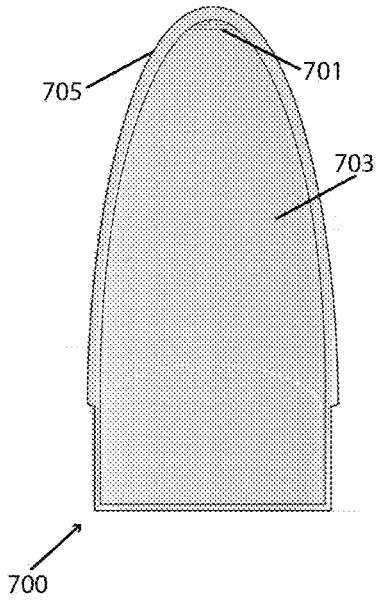
FIG. 7*a* is a side/interior view of another form of housing section, including, among other aspects, internal structural members, which may be assembled with other such housing sections (e.g., one of two similar housing sections) to form a reversibly-divisible nose cone, in accordance with embodiments of the present invention.

FIG. 7*a* is a side/interior view of another form of housing section 700 which may be assembled with other such housing sections (e.g., one of two similar housing sections) to form a reversibly-divisible nose cone, in accordance with embodiments of the present invention. In some embodiments, such a housing section includes one or more internal structural support(s) or reinforcements. For example, in some embodiments, such a structural support(s) includes one or more internal strut(s), such as example internal struts 701, located within internal void 703 (toward a tip 705, of housing section 700. However, it should also be understood that, in various other embodiments, a greater number, fewer, a different location of, or no such internal struts, are provided.

Figure 7B:
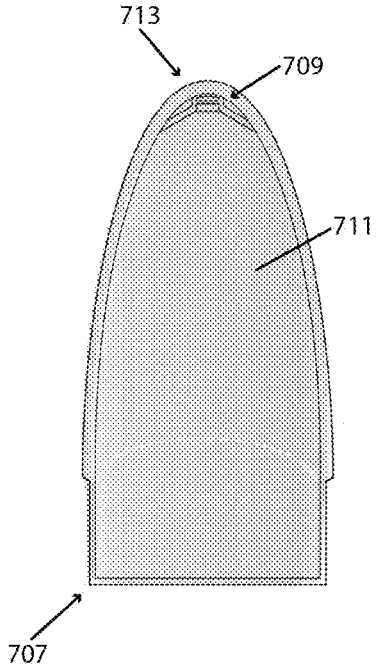
FIG. 7*b* is a side/interior view of another form of housing section, including a greater number of internal structural members than set forth in FIG. 7*a*, above, which may be assembled with other such housing sections (e.g., one of two similar housing sections) to form a reversibly-divisible nose cone, in accordance with embodiments of the present invention.

FIG. 7*b* is a side/interior view of another form of housing section 707 which may be assembled with other such housing sections (e.g., one of two similar housing sections) to form a reversibly-divisible nose cone, in accordance with embodiments of the present invention. As with housing section 700, discussed above, in some embodiments, such a housing section includes one or more internal structural support(s) or reinforcements. Thus, in some embodiments, such a structural support(s) includes one or more internal strut(s), which are a greater number and/or larger and more complex in arrangement than struts 701, such as example internal struts 709, located within internal void 711 (toward a tip 713, of housing section 707. Owing to their greater number, size and/or complexity, in some embodiments, internal struts 709 are capable of absorbing a greater amount of strain than in other embodiments, with less, smaller or less complex strut arrangements.

Figure 8A:
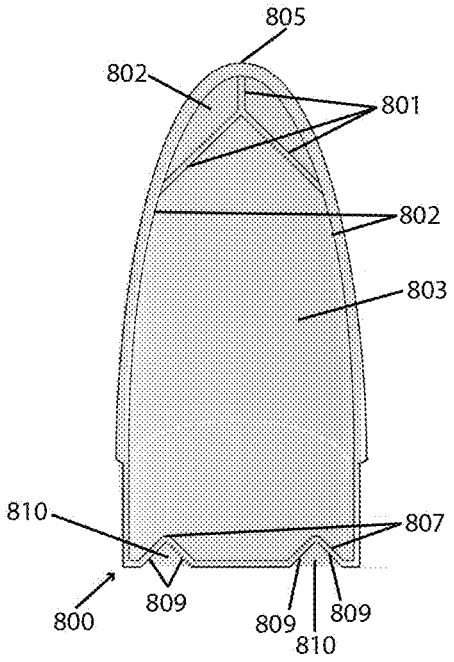
FIG. 8*a* is a side/interior view of another form of housing section, including, among other aspects, larger internal structural members than set forth in FIG. 7*b* and ejection charge receiving pockets, which may be assembled with other such housing sections (e.g., one of two similar housing sections) to form a reversibly-divisible nose cone, in accordance with some embodiments of the present invention.

FIG. 8*a* is a side/interior view of another form of housing section 800 which may be assembled with other such housing sections (e.g., one of two similar housing sections) to form a reversibly-divisible nose cone, in accordance with embodiments of the present invention. As with housing sections discussed immediately above, in some embodiments, such a housing section includes one or more internal structural support(s) or reinforcements. Thus, again, in some embodiments, such a structural support(s) includes one or more internal strut(s)—namely, internal struts 801—which are larger and more widely spaced away from one another and an internal wall 802 of housing section 800, in their arrangement than internal struts 701 or internal struts 709. Again, internal struts 801 are located within an internal void (now internal void 803), toward a tip 805, of housing section 800. Owing to their greater size and internal spacing, in some embodiments, internal struts 801 are capable of absorbing a greater impact than in other embodiments, with less spacing between such internal struts or other internal supports.

In addition, in some embodiments, housing section 800 includes ejection charge receiving pockets 807. In some embodiments, ejection charge receiving pockets 807 include angled walls 809, creating concavities 810, directing an ejection charge upward, among other benefits.

Figure 8B:
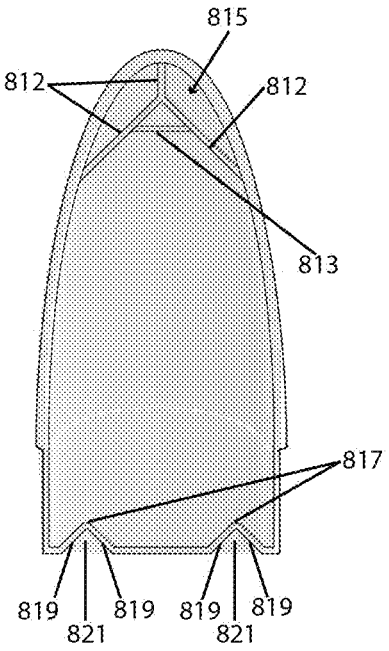
FIG. 8*b* is a side/interior view of another form of housing section, similar to the housing section set forth above, in FIG. 8*a*, but also including an additional horizontal internal support, in accordance with some embodiments of the present invention.

FIG. 8*b* is a side/interior view of another form of housing section 811, similar in nature to the example housing section set forth above, as housing section 800, but including an additional, horizontal cross member 813, bridging between the other internal struts, now shown as struts 812, and creating a cross-supporting framework 815.

In addition, in some embodiments, again as set forth above for housing section 800, housing section 811 includes ejection charge receiving pockets, now shown as ejection charge receiving pockets 817. In some embodiments, ejection charge receiving pockets 817 include angled walls 819, creating concavities 821, directing an ejection charge upward, among other benefits.

Figure 9:
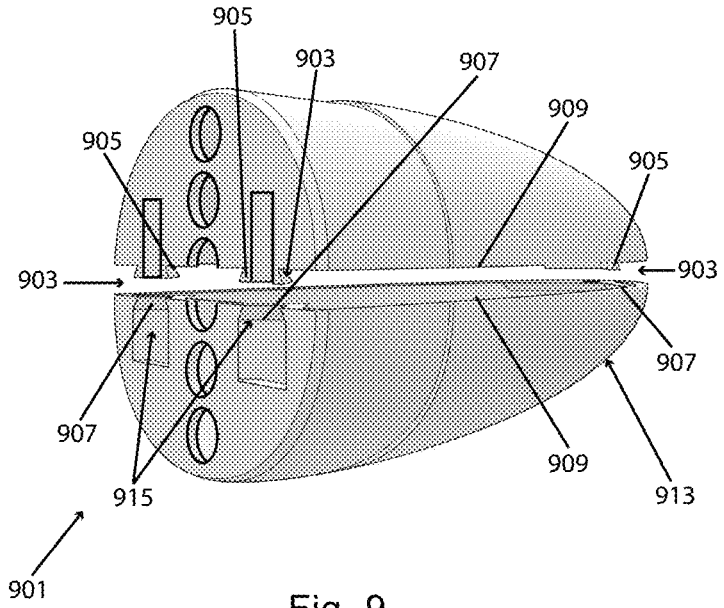
FIG. 9 is a perspective drawing of another example plurality of housing sections for forming a reversibly-divisible nose cone, including multiple locking mechanisms at some example locations on or about the housing sections, in accordance with some embodiments of the invention.

FIG. 9 is a perspective drawing of another example plurality of housing sections 901 for forming a reversibly-divisible nose cone, in accordance with some embodiments of the invention. Like certain other embodiments set forth in the present application, plurality of housing sections 901 include a locking mechanism, in the form of reversible, dovetail-type joints 903, each including a male portion 905 and a female portion 907, which fit one another. Unlike certain other embodiments, however, dovetail-type joints 903 do not line the entire interfacing area, along abutting parallel edges 909, of each of the plurality of housing sections 901. Instead, dovetail-type joints 903 are provided at particular points where the plurality of housing sections 901 are to be joined. For example, in some embodiments, one of dovetail-type joints 903 (for example, tip fastener 911) is provided on or about a tip 913 of the plurality of housing sections 901. As another example, in some embodiments, one or more of the dovetail fasteners (such as lower fasteners 915) is provided on or about a lower section of the plurality of housing sections 901.

In a virtually unlimited number of alternative embodiments, locking mechanism(s) may be provided at a wide variety of other locations, in a wide variety of numbers, patterns and arrangements, other than the examples specifically set in the present application. The examples set forth in the present application are merely examples, illustrating some principles of the invention.

Figure 10:
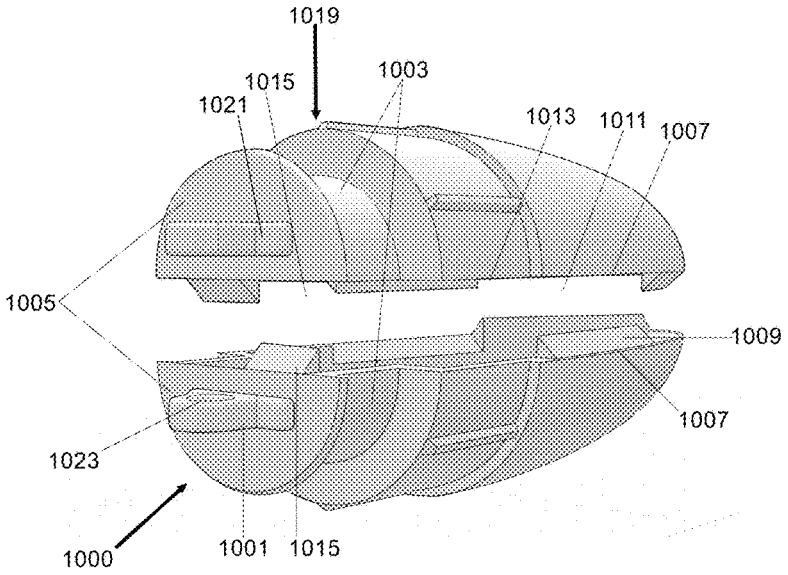
FIG. 10 is a perspective drawing of another example plurality of housing sections for forming a reversibly-divisible nose cone, including a locking mechanism(s) incorporating a spool formed by shock cord mounting arms, in accordance with some embodiments of the invention.

FIG. 10 is a perspective drawing of another example plurality of housing sections 1001 for forming a reversibly-divisible nose cone, including a locking mechanism(s) incorporating a spool 1003 formed by shock cord mounting arms 1005, in accordance with some embodiments of the invention.

Like certain other embodiments set forth in the present application, plurality of housing sections 1001 include a locking mechanism, in the present example, being in the form of reversible joints, such as example reversible joint 1007, including slanted male portions 1009 and a female pocket portion 1011, which fit one another. As with the example plurality of housing sections 1001, such joints do not line the entire interfacing area, along abutting parallel edges 1013, of each of the plurality of housing sections 1001. Instead, such joints are provided at particular points where the plurality of housing sections 1001 are to be joined. For example, in some embodiments, at least one such joint (for example, lower fastener 1015) is provided on or about the lower section 1019 of the plurality of housing sections 1001.

In addition, another form of lower fastener is formed by spool 1003, in some embodiments. For example, in some embodiments, each of the shock cord mounting arms 1005 include a lower tab 1021, each such lower tab including an exposed, lower shock-cord mounting eyelet, such as example eyelet 1023. In some such embodiments, after threading and/or tying the shock cord (not pictured) to each of such an eyelet, the shock cord may then be wound around the spool 1003 formed by conjoining plurality of housing sections 1001 and shock cord mounting arms 1005. In this way, and especially in embodiments where the shock cord includes an elastomeric material, spool 1003, with such a shock cord wound tightly around it, serves as a locking mechanism which is effective until an ejection charge ejects a nose cone formed from the conjoined plurality of housing sections, causing the shock cord to extend and unfurl from spool 1003, which then separates (along with plurality of housing sections 1001).

Figure 11:
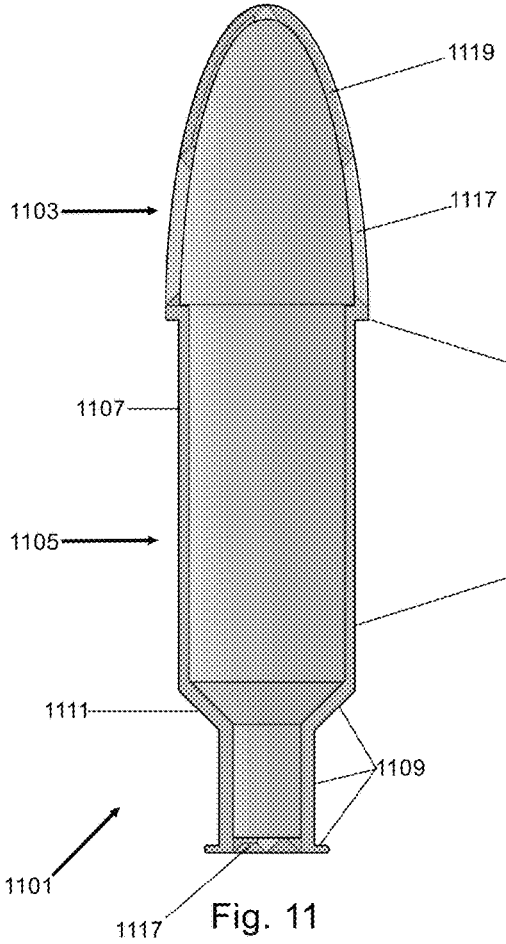
FIG. 11 is a side/interior view of another form of housing section of a nose cone, including, among other aspects, a more greatly elongated lower housing portion, and with a smaller spool section, than other nose cone housing sections set forth in this application, in accordance with some embodiments.

FIG. 11 is a side/interior view of another form of housing section 1101 of a nose cone, including, among other aspects, a more greatly elongated lower housing portion, and with a smaller spool section, than other nose cone housing sections set forth in this application, in accordance with some embodiments.

As with other embodiments of nose cone housing sections set forth in the present application, housing section 1101 includes an upper portion 1103, and a lower portion 1105. Also as with other example housing sections set forth in the present application, when joined together with another, similar housing section, housing section 1101 forms a nose cone, also with a corresponding upper portion and lower portion. For example, when so joined, upper portion 1103 forms a generally conically-shaped tip, and lower portion 1105 forms a generally cylindrical neck, due to the half-cylindrical shape of neck section 1107. As discussed above, such a cylindrical neck is configured to be inserted into a main body of a rocket, such as any of the main bodies for rockets discussed in this application. However, neck section 1107 is more greatly elongated than most other nose cone sections set forth in the present application, and more greatly elongated than traditional model rocket nose cones—that is the ratio of the length to width of neck section 1107 and lower portion 1105 generally, is greater than in most other nose cone section embodiments in the present application, and in the art.

In addition, as with some other embodiments of nose cone sections set forth in the present application, a spool section 1109 is included, about which a model rocket shock cord may be wound, in some embodiments. The diameter of spool section 1109 is narrower than other spool sections set forth in the present application, relative to the width of the upper portion 1103, lower portion 1105, than other embodiments of the present application. In addition, unlike other nose cone sections including integrated spool(s) set forth in this application, housing section 1101 includes a tapering transitional area 1111, between the spool section 1109 and a neck section 1107. As discussed above, this tapering transitional area 1111 forms an outward, sloped lower surface(s) of nose cone, when housing section 1101 is combined with another, similar housing section. When an ejection charge collides, upwardly, with such sloped lower surface, it may causing the ejection charge to press, and hold the housing sections together (at least initially during an ejection phase, as the nose cone is ejected from a main body of the rocket in which it was inserted).

Figure 12:
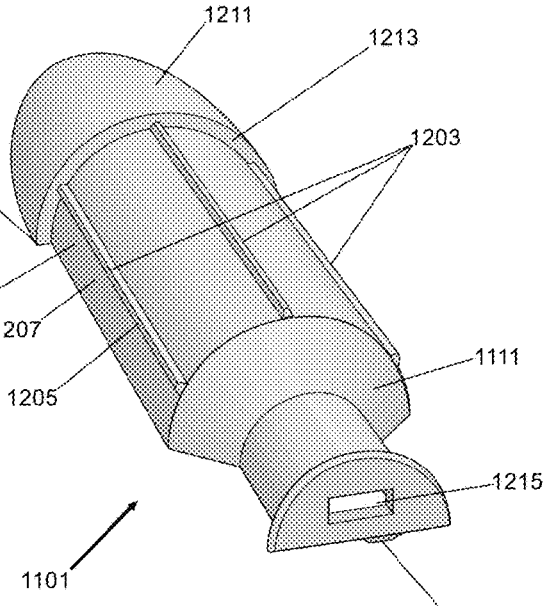
FIG. 12 is a perspective drawing of the same housing section of a nose cone set forth in reference to FIG. 11, above, depicting some aspects visible from an exterior view of the nose cone, in accordance with some embodiments.

FIG. 12 is a perspective drawing of the same housing section 1101 of a nose cone set forth in reference to FIG. 11, above, depicting some aspects visible from an exterior view of the nose cone, in accordance with some embodiments. For example, longitudinally-oriented raised ribs 1203 are included, spaced apart from one another at regular lateral distance intervals. Although the example of three (3) such raised ribs of a particular relative thickness and length in comparison to the remainder of housing section 1101 and neck section 1107 is provided, it should be understood that, in other embodiments, more, or less ribs, of different lengths, thicknesses are, instead or in addition, be provided. It should also be noted that raised ribs 1203 are raised more greatly above the surface of neck section 1107, resulting in a larger gap between their outer surfaces, such as example outer surface 1205, and the cylindrical outer surface 1207 of neck section 1107, on which they are mounted (or, in some embodiments, with which they are integrated, e.g., formed in one piece with the housing section 1101 via injection molding). In other words, the cylindrical outer surface 1207 of neck section 1107 is inset more deeply from the diameter of a low end 1209 of a half-cone 1211 of upper portion 1103. As a result, there is a shoulder 1213, which is a flat, lower surface extending from the low end 1209 to the cylindrical outer surface 1207, which shoulder is wider (a.k.a., deeper) relative to the volume and diameter of the upper portion 1103 of housing section 1101 as a whole, than in other embodiments.

As with other housing sections for nose cones set forth in this application, housing section 1101 may include any other features set forth elsewhere in this application, and in the art. For example, in some embodiments, an attachment point, such as threading hole 1215 may be included, about which a shock cord(s) may be tied, in some of such embodiments. In addition, in some embodiments, one or more interlocking tabs, such as example tab 1217, or example tabs 1117, and complementary pockets, such as example tab-receiving, interlocking pockets, such as example tab-receiving pocket 1119, may be included. Such a series of tabs, and pockets into which such tabs insert and interlock, may serve as a type of locking mechanism, temporarily joining multiple housing sections (e.g., two halves) to form a rocket nose cone, in accordance with some embodiments.

Figure 13:
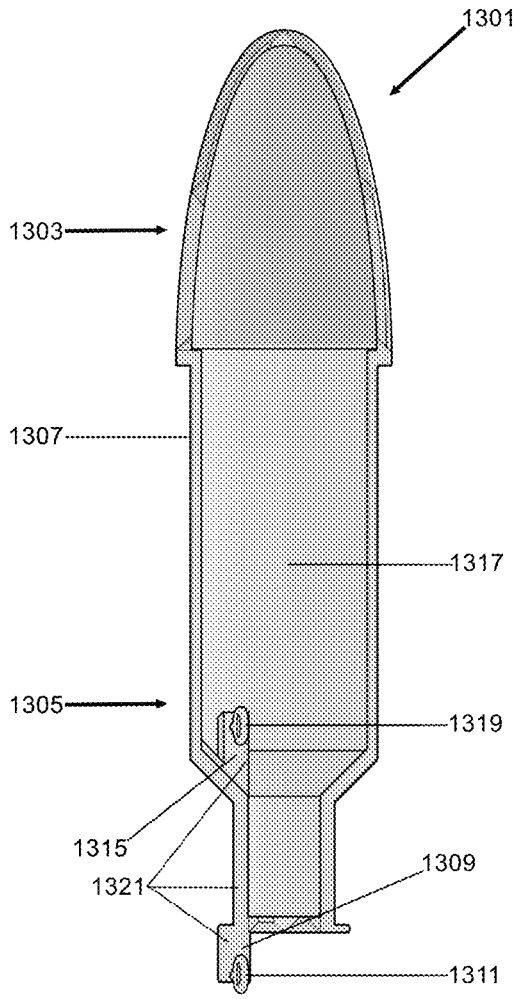

FIG. 13 is a side/interior view of another form of housing section 1301 of a nose cone, including, among other aspects, a more greatly elongated lower housing portion, and a smaller spool section, than some other nose cone housing sections set forth in this application, in accordance with some embodiments.

As with other embodiments of nose cone housing sections set forth in the present application, housing section 1301 includes an upper portion 1303, and a lower portion 1305. Also as with other example housing sections set forth in the present application, when joined together with another, similar housing section (not pictured, but would appear the same as housing section 1301 in some embodiments), housing section 1301 forms a nose cone, also with a similar corresponding upper portion and lower portion. In some such embodiments, such a similar housing section is identical to housing section 1301, to which housing section 1301 may be joined, and includes all structures and arrangements as discussed herein with respect to housing section 1301. In other embodiments, such a similar housing section is a mirror image structure to housing section 1301, to which housing section 1301 may be joined. When so joined together, upper portion 1303 forms a generally conically-shaped tip, and lower portion 1305 forms a generally cylindrical neck, due to the half-cylindrical shape of neck section 1307, similar in nature to other cylindrical neck structures set forth in the present application (such as, for example, the cylindrical neck set section 1107 forth in FIG. 11, above). As also discussed above, such a cylindrical neck is configured to be inserted into a main body of a rocket (i.e., into a hollow cylindrical tube thereof), such as any of the main bodies for rockets discussed in this application. However, neck section 1307 is more greatly elongated than most other nose cone sections set forth in the present application, and more greatly elongated than traditional model rocket nose cones—that is, the ratio of the length to width of neck section 1307 and lower portion 1305 generally, is greater than in most other nose cone section embodiments in the present application, and in the art.

As with other housing sections for model rocket nose cones set forth in the present application, in some embodiments, housing section 1301, and/or a similar housing section to which it may be joined, includes one or more shock cord mounting arms, such as the example shock cord mounting arm(s) 1309 (and/or similar or identical shock cord mounting arm(s) located on such another, similar housing section to housing section 1301 as discussed above), and/or, in some embodiments, other shock cord mounting structures. As with other shock cord mounting arms set forth in the present application, in some embodiments, shock cord mounting arm(s) 1309 may include one or more eyelets, such as example eyelet 1311, through which one or more shock cords may be threaded, and to which such shock cords may be tied, or otherwise bound, to shock cord mounting arm(s) 1309. For example, in some embodiments, to connect a model rocket shock cord(s) to such a shock cord mounting arm(s) 1309, the shock cord(s) are threaded through example eyelet 1311. In some such embodiments, the shock cord(s) are then knotted, tied or otherwise attached to eyelet 1311 in preparation for a model rocket flight and recovery. In some embodiments, the shock cord(s) are threaded through (but not tied to) example eyelet 1311, and then tied to the similar or identical eyelet present on the counterpart, other similar housing section to housing section 1301 (discussed above) prior to joining the two housing sections together in preparation for flight and recovery. In this way, upon ejection from an interior of a main body of a model rocket, e.g., at the apogee of flight, and greater exposure to wind, the shock cord permits the separation of the two sections forming the model rocket nose cone, in some embodiments, because the shock cord may pay out through example eyelet 1311.

In addition, in some embodiments, housing section 1301 includes one or more internal mounting arms, such as example internal mounting arm(s) 1315, located at least partially within a payload-carrying volume, such as example payload bay(s) 1317. In some such embodiments, additional device(s) may be provided within payload bay(s) 1317. For example, in some embodiments, a parachute or other model rocket recovery device may be so provided, held within payload bay(s) 1317, which may be released upon such a separation (as discussed above). In some embodiments, such additional device(s) may be connected to housing section 1301, for example, via a device tether or cord (not pictured) connected with such additional device(s). For example, in some embodiments, such a device tether or cord may be tied to example upper eyelet 1319, mounted on interior mounting arm(s) 1315, present within payload bay(s) 1317. Alternatively, or in addition, in some embodiments, for example, such a device tether or cord may be tied to a similar or identical upper eyelet, mounted on a similar or identical interior mounting arm attached to, or integral with, the housing section similar or identical to housing section 1301 (interlocked with housing section 1301 to form the nose cone (as discussed above)), which similar or identical interior mounting arm is therefore also present within payload bay(s) 1317. In some embodiments, payload bay(s) 1317 may include a payload bay configured to hold electronics (i.e., an "electronics bay" or "e-bay"). In some embodiments, devices provided within such an e-bay may include an electronic device, such as a camera, which, similarly to the recovery device set forth above, may be exposed and/or released from such an e-bay upon such ejection and separation of the two nose cone sections.

In some embodiments, such an electronic device may include a different form of connector than a tether or cord, such as a proprietary connector, for interfacing with upper eyelet 1319, or another connector disposed on a structural component of the payload bay(s) 1317.

In some embodiments, such a shock cord(s) is/are wound around any or all of the shock cord mounting arms present in preparation for a model rocket flight. And, in some embodiments, where at least one of the multiple shock cord mounting arms are included within each of the housing sections (i.e., housing section 1301, and such a similar housing section to which it is joined, as discussed above), such a shock cord, when so wound, may aid in conjoining the housing sections, at least, unless and until an ejection charge separates neck section 1307 from the interior of a main body of a rocket, in some embodiments.

As with other shock cord mounting arms set forth in the present application, in some embodiments, shock cord mounting arm(s) 1309 and/or internal mounting arm(s) 1315 may be attached to, or integrated with, the remainder of housing section 1301 at or about particular connection or mounting points or areas of housing section 1301.

However, in some embodiments, rather than being attached to or formed by shock cord mounting arm(s) 1309 and/or internal mounting arm(s) 1315, in some embodiments, as pictured, any or all of the eyelets discussed herein may each be a form of reversible connector hardware (e.g., in a proprietary format). In some such embodiments, such eyelets (and such reversible connector hardware) may include a stronger and/or denser material (e.g., a metal) than materials present elsewhere in housing section 1301 (e.g., formed from a polymer, such as a plastic, such as polyethylene terephthalate (PET)). As another example, in some embodiments, shock cord mounting arms 1309 may include example main structural bars or other parts 1321, which may be composed of materials present in the majority of housing section 1301. However, in some such embodiments, example main structural bars or other parts 1321 may be connected to such eyelet(s), e.g., via a hole into which a pointed and/or threaded end of the eyelets is inserted and fastened. In some embodiments, and, again, as with other shock cord mounting arms set forth in the present application, example shock cord mounting arms 1309 may be curved or angled, for example, due to mounting arm bend(s). In some such embodiments, such bend(s) may be caused by the angle of attachment of such eyelets as discussed above. For example, in some embodiments, as pictured, such eyelets are mounted on such main structural bar(s) or other parts 1315 at an angle (such as a right angle, to such bar(s), again, as pictured).

It should be noted that, although the example of two (2) nose cone housing sections, forming a model rocket nose cone, has been provided, for ease of understanding, in other embodiments, any number of nose cone housing sections (e.g., 3, 4, 5, etc.) may be provided. In some such embodiments, each of such a plurality of nose cone housing sections may be (e.g., radially) symmetrical and/or similar or identical to each other. However, in other embodiments, such nose cone housing sections may, alternatively, not by identical or symmetrical with each other. Furthermore, although the example of a model rocket nose cone is provided, it should be understood that many, if not all, of the aspects set forth in the present application with respect to model rocket nose cones may be provided for other types of rockets, such as, but not limited to, ballistic missiles.

As with any other embodiment, example, and or figure set forth in the present application, the embodiments set forth in, and discussed with reference to, FIG. 1 are not exhaustive, and are merely examples, of the many alternative embodiments falling within the scope of the invention, as will be readily apparent to those of skill in the art. Thus, the embodiments set forth in, and discussed with reference to, FIG. 1, are not limiting, and should not be read to limit any claims of the present application.

What is claimed is:

1. A divisible model rocket nose cone, comprising:

a nose cone housing comprising a plurality of housing sections;

a locking mechanism, configured to conjoin the plurality of housing sections;

a plurality of shock cord mounting arms each including an eyelet adapted to accept a model rocket shock cord, each of which plurality of shock cord mounting arms is attached to or integral with at least one of the plurality of housing sections;

wherein the locking mechanism is configured to temporarily conjoin the plurality of housing sections while the nose cone is inserted within an interior tube of a main body of a rocket, prior to ejection of the nose cone from the interior tube of the main body of the rocket; and wherein the locking mechanism is configured to unlock and permit a separation of the plurality of housing sections from each other, after the nose cone ejects from the interior tube of the main body of the rocket.

2. The divisible model rocket nose cone of claim 1, wherein the plurality of shock cord mounting arms are each attached to or integral with a lower surface of at least one of the housing sections.

3. The divisible model rocket nose cone of claim 2, wherein the plurality of shock cord mounting arms have a non-perpendicular angle relative to the lower surface, and wherein each eyelet is located at or about a distal end of one of the plurality of shock cord mounting arm(s).

4. The divisible model rocket nose cone of claim 1, wherein the locking mechanism comprises a lip-and-groove alignment mechanism, located on or about conjoinable edges of the plurality of housing sections.

5. The divisible model rocket nose cone of claim 1, wherein the nose cone comprises an internal void.

6. The divisible model rocket nose cone of claim 5, wherein the nose cone comprises an interior platform, located within the internal void.

7. The divisible model rocket nose cone of claim 6, wherein the interior platform is configured to open upon the separation of the plurality of housing sections.

8. The divisible model rocket nose cone of claim 1, wherein the nose cone housing has a generally conical shape transitioning to a generally cylindrical shape at a proximal end of the nose cone housing, and wherein a portion of the generally cylindrical shape comprises a depression, allowing the nose cone housing to be partially inserted into the interior tube of the main body of the rocket.

9. The divisible model rocket nose cone of claim 1, wherein the eyelet comprises an interior hole, configured to receive the model rocket shock cord, when the model rocket shock cord is threaded through the interior hole.

10. The divisible model rocket nose cone of claim 9, comprising a plurality of eyelets within one of the plurality of shock cord mounting arms, and wherein each of the plurality of eyelets is attached at a different location on or about the one of the plurality of shock cord mounting arms.

11. The divisible model rocket nose cone of claim 1, wherein the eyelet comprises a denser, stronger material than another material comprised in the nose cone housing.

12. The divisible model rocket nose cone of claim 11, wherein the denser, stronger material is a metal, and wherein the another material is a polymer.

13. The divisible model rocket nose cone of claim 12, wherein the polymer comprises polyethylene terephthalate (PET).

14. A method for using a model rocket nose cone, comprising the following steps:

providing a model rocket nose cone, comprising:

a plurality of housing sections comprised in a nose cone housing;

a locking mechanism, configured to conjoin the plurality of housing sections;

a plurality of shock cord mounting arms each including an eyelet adapted to accept a model rocket shock cord, each of which plurality of shock cord mounting arms is attached to or integral with at least one of the plurality of housing sections;

wherein the locking mechanism is configured to temporarily conjoin the plurality of housing sections while the nose cone is inserted within an interior tube of a main body of a rocket, prior to ejection of the nose cone from the interior tube of the main body of the rocket; and;

wherein the locking mechanism is configured to unlock and permit the separation of the plurality of housing sections from each other, after the nose cone decouples from the interior tube of the main body of the rocket.

15. The method for using a model rocket nose cone of claim 14, wherein each of the plurality of shock cord mounting arms is attached to or integral with a lower surface of one of the plurality of housing sections.

16. The method for using a model rocket nose cone of claim 14, wherein a linear center of at least one of the plurality of shock cord mounting arms and/or the eyelet has a non-perpendicular angle relative to the lower surface, and wherein the eyelet is located at or about a distal end of one of the plurality of shock cord mounting arm(s).

17. The method for using a model rocket nose cone of claim 16, comprising the following additional step:

forming a rocket comprising the model rocket nose cone, by partially inserting the model rocket nose cone into the main body of the rocket.

18. The method for using a model rocket nose cone of claim 17, comprising the following additional step:

launching the rocket comprising the model rocket nose cone.

19. The method for using a model rocket nose cone of claim 18, comprising the following additional step:

ejecting the nose cone from the main body of the rocket, and separating the plurality of housing sections from each other.

20. The method for using a model rocket nose cone of claim 19, comprising the following additional step:

releasing a payload from an interior space within the nose cone.

* * * * *